US005462594A

United States Patent [19]

Rantanen

[11] Patent Number: 5,462,594

[45] Date of Patent: Oct. 31, 1995

[54] COATING DEVICE FOR COATING OF A SIZE-PRESS ROLL, PAPER OR BOARD

[75] Inventor: Rauno Rantanen, Muurame, Finland

[73] Assignee: Valmet Paper Machinery Inc., Helsinki, Finland

[21] Appl. No.: 65,569

[22] Filed: May 20, 1993

Related U.S. Application Data

[63] Continuation-in-part of Ser. No. 686,026, Apr. 16, 1991, Pat. No. 5,246,497.

[30] Foreign Application Priority Data

Apr. 19, 1990 [FI] Finland ..... 901967

[51] Int. Cl.[6] ..... B05C 1/08

[52] U.S. Cl. ..... 118/249; 118/258; 118/259; 118/262; 118/414

[58] Field of Search ..... 118/244, 248, 118/249, 258, 259, 260, 261, 262, 414

[56] References Cited

U.S. PATENT DOCUMENTS

| | | | |
|---|---|---|---|
| 2,970,564 | 2/1961 | Warner | 118/249 |
| 3,540,410 | 11/1970 | Osborne, Jr. et al. | 118/249 |
| 3,762,365 | 10/1973 | Herzog | 118/249 X |
| 4,606,264 | 8/1986 | Agronin et al. | 100/38 |
| 4,704,296 | 11/1987 | Leanna et al. | 118/249 X |
| 4,757,582 | 7/1988 | Verkasalo | 29/116.2 |

*Primary Examiner*—David A. Simmons
*Assistant Examiner*—Paul M. Rivard
*Attorney, Agent, or Firm*—Steinberg, Raskin & Davidson

[57] ABSTRACT

The invention relates to a coating device for coating, e.g. a size-press roll, paper or board or of an equivalent moving base. The coating device comprises a revolving coating bar which rests against a moving base. The coating bar extends across the machine width and is supported in a cradle substantially over its entire length. The coating bar spreads and smoothes the coating agent onto the moving base which coating agent is introduced into the coating device in the running direction of the moving base before the coating bar. The coating bar in accordance with the invention is a smooth bar of large diameter arranged against the moving base so that the profile of coating quantity can be controlled.

20 Claims, 6 Drawing Sheets

COATING DEVICE FOR COATING OF A SIZE-PRESS ROLL, PAPER OR BOARD

This application is a continuation-in-part of U.S. Ser. No. 07/686,026 filed Apr. 16, 1991 now U.S. Pat. No. 5,246,497 issued Sep. 21, 1993.

BACKGROUND OF THE INVENTION

The invention relates to a coating device for coating a size-press roll, paper or board or an equivalent moving base. The coating device comprises a revolving coating bar which rests against the moving base and extends across the machine width. The coating bar is supported in a cradle substantially over its entire length and is fitted to spread and to smooth a coating agent onto the moving base. The coating agent is introduced into the coating device in the direction of running of the moving base before the coating bar.

The invention is further related to a coating device for coating a size-press roll, paper or board or an equivalent moving base, comprising a coating-agent chamber including a revolving coating bar supported against a moving base and which acts as a coating member. The coating bar extends across the machine width, and the coating-agent chamber is defined by the front wall of the coating-agent chamber, by the lateral seals of the coating device, and by the moving base. The coating agent is arranged to be fed into the coating-agent chamber under pressure.

At present, in the coating of paper or board, two alternative methods and devices are commonly used, i.e. a blade coater or a bar coater. The present invention is expressly related to the latter, bar coaters, which have proved excellent especially in the film size press technique. The material of the coating bars currently in use is usually steel, and, in view of increasing the service life of the bar, the bars are provided with chromium plating. In surface sizing of paper, bars with fully smooth faces have not been used. Rather, the face of the coating bar has been provided with grooves, or alternatively steel wire is wound onto the bar to form an arrangement similar to grooves on the bar face. A grooved bar is used for the surface sizing of paper because the thickness of the size film to be applied onto the base to be coated is determined by means of the depth of the grooves.

A grooved bar is, however, poorly suitable for the preparation of thin size films, because it is very difficult to manufacture grooves of sufficiently small scale. On the other hand, such small grooves are easily contaminated. It is a further highly significant drawback of grooved bars that they are worn rapidly. Pigmenting with a high dry solids content is also entirely impossible with grooved bars, because the wear of the bars is excessive in this connection. The diameters of the coating bars currently in use have been very small. Small-diameter bars are used because the bar ought to be able to adapt itself to the shape of the roll face in the size press in order that the profile of the size film could be made suitable and correct. Generally, the order of magnitude of the diameter of currently used coating bar is about 10 mm.

It has not been possible to use bars of large diameter because, owing to their thickness, they have been too rigid to provide an adequate profiling. In respect to the prior art, reference is made in particular to U.S. Pat. No. 2,970,564, from Which a device is known for spreading of a size film or of a pigment coating film onto the rolls in a size press, said films being transferred to the paper in the nip in the film size press. In the method described therein, smooth or grooved bars are used for the metering of the size film. It is stated therein that while it is possible to use a smooth-faced bar of small diameter (diameter about 9 mm) for surface sizing, such a bar is unsatisfactory. Accordingly, a corresponding device has never been applied in practice. In respect of the prior art, reference is further made to FI Patent No. 30,147.

OBJECT AND SUMMARY OF THE INVENTION

Accordingly, an object of the present invention is to provide a coating bar which avoids the drawbacks of the prior art and by whose means a significant improvement is produced in particular in surface sizing of paper.

It is another object of the present invention to provide a new and improved coating device to coat a web which is travelling in an upward direction through the coating device.

In view of achieving these objects, and others, the invention is mainly characterized in that the coating bar is a smooth bar of large diameter, which is fitted against the moving base so that the profile of coating quantity can be regulated under control. It is an important advantage of the present invention that while using a large-diameter coating bar, it is now possible to run very thin size films and coating pastes of high dry solids content even at high running speeds. With the device in accordance with the invention, the level of the coating quantity and the profile of the coating have been very good.

In a preferred embodiment, the paper or board is arranged to move in an upward direction through a nip formed by a pair of size-press rolls. In this embodiment, a pressurized and closed coating-agent chamber, which is inherently airtight, is placed before the coating bar so that the coating agent is introduced onto the moving base, i.e. the pair of rolls, to be spread and smoothed by the coating bar. In this manner, the coating agent used in the coating process of the present invention can be thicker than in prior art processes utilizing coating bars.

Further advantages and characteristic features of the invention are apparent from the following detailed description of the invention.

BRIEF DESCRIPTION OF THE DRAWINGS

The following drawings are illustrative of embodiments of the invention and are not meant to limit the scope of the invention as encompassed by the claims.

FIG. 2A is a schematic sectional view of an alternative embodiment of a coating bar construction in a coating device in accordance with the present invention.

DETAILED DESCRIPTION OF THE INVENTION

Figure 1:
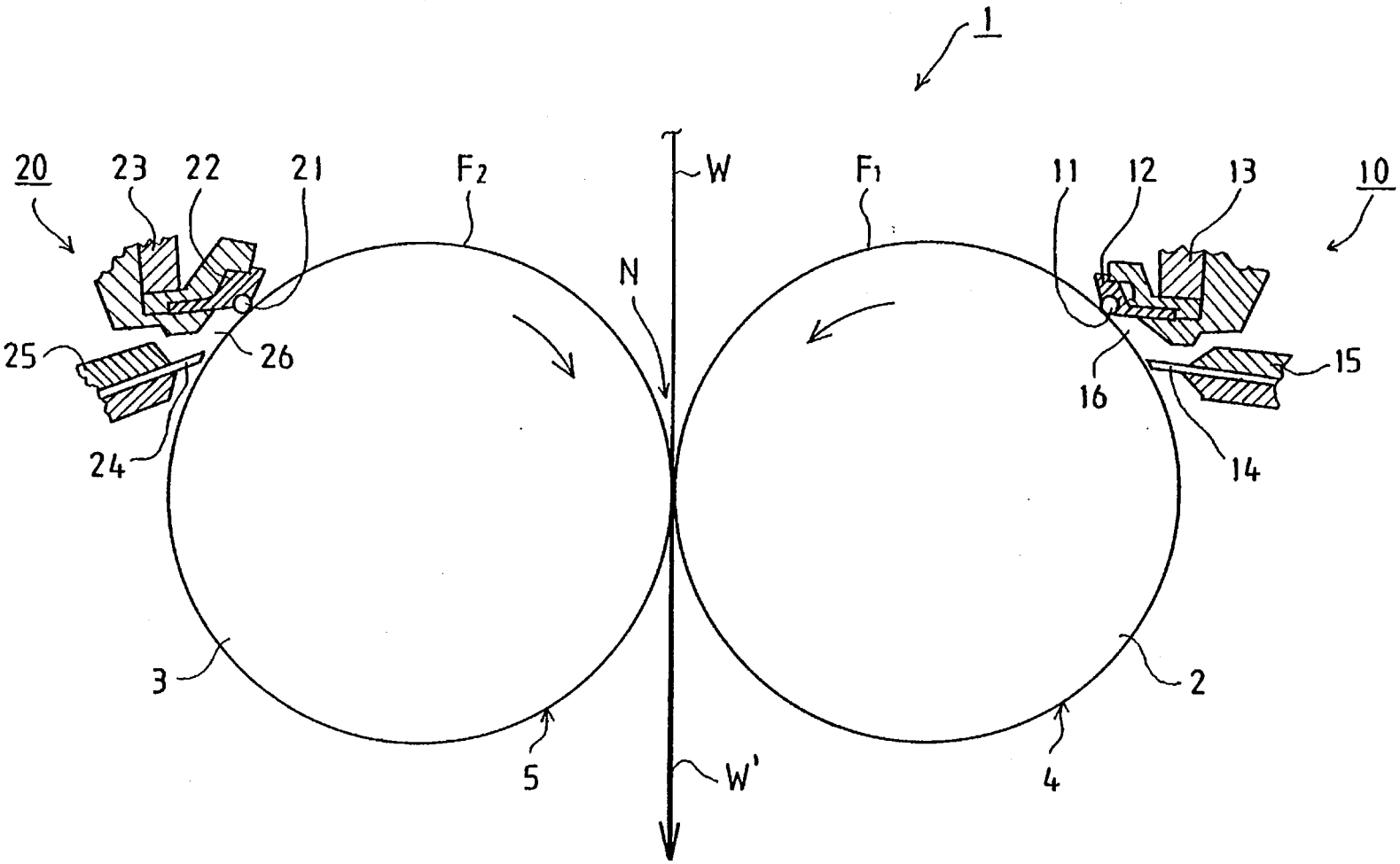
FIG. 1 is a fully schematic side view of a film size press in which a coating device in accordance with the invention is applied.

FIG. 1 is a schematic illustration of the size press, which is denoted generally with reference numeral 1. The film size press 1 comprises size press rolls 2 and 3 so that the first roll 2 and the second roll 3 form a nip N between them, the paper or board web W being passed through said nip. In the film size press 1, a film size F1 is metered onto the face 4 of the first roll by means of a first coating device 10 and, in a corresponding way, a second size film F2 is metered onto the face 5 of the second roll by means of a second coating device 20. In the roll nip N, the size films F1 and F2 are transferred onto the paper or board web W running through the nip. In FIG. 1, the coated web is denoted with reference W'.

In the film size press 1 shown in FIG. 1, the coating devices 10 and 20, by whose means the size films F1 and F2 are spread onto the faces 4 and 5 of the rolls 2 and 3 in the size press, are bar coaters, which are substantially equal to one another, as is shown in FIG. 1. The coating devices 10 and 20 are coating devices of so-called short-dwell type, in which the coating agent is introduced into a pressurized coating-agent chamber 16, 26 placed before the coating bar 11, 21. Besides being defined by the coating bar 11, 21, the chamber is also defined by the roll face 4, 5, by the front wall 14, 24 of the coating-agent chamber, as well as by possible lateral seals, if any (not shown).

The coating bar 11, 21 is provided with a dedicated drive gear (not shown), by whose means the coating bar 11, 21 is rotated in directions opposite to the directions of rotation of the rolls 2, 3. Further, in FIG. 1, the holders of the cradles of the coating bars are denoted with reference numerals 13 and 23, and the holders of the front wall with reference numerals 15 and 25. Further, between the coating-bar 11, 21, cradle 12, 22 and the holder 13, 23, an ordinary loading hose or equivalent (not shown) is fitted, by whose means the coating bar 11, 21 can be loaded against the roll face 4, 5 to produce the desired loading pressure.

According to the invention, in the coating devices 10, 20 shown in FIG. 1, a smooth-faced coating bar 11, 21 is employed. In addition to the fact that the coating bar 11, 21 in accordance with the invention has a smooth face, the diameter of the coating bar 11, 21 is substantially larger than prior art coating bars. In the coating device in accordance with the invention, the diameter of the coating bar 11, 21 is at least 18 mm, and, in test runs, very good results have been obtained with a coating device in which the diameter of the coating bar was 20 mm. A dimension even larger than this is considered to be most appropriate bar diameter, and the diameter of the bar is optimally from about 25 to about 80 mm.

In particular in wide machines, it is necessary to regulate the profile of the coating quantity produced in the coating device, such regulation would be substantially impossible with a large-diameter coating bar if constructions known from the prior art small-diameter bars were employed in which constructions the coating-quantity profile can be controlled by regulating the loading of the bar locally, in which case the loading profile is transferred to the coating process as the coating bar is deflected. For this reason, in the device in accordance with the invention, alternative arrangements have been developed for the purpose of regulating the loading profile.

Figure 2:
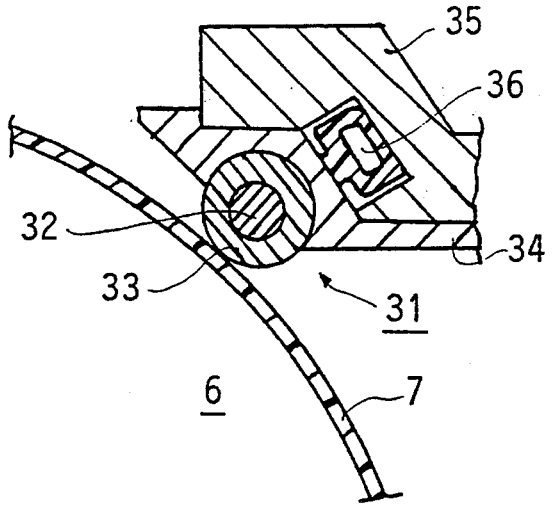
FIG. 2 is a schematic sectional view of an alternative embodiment of a coating-bar construction in a coating device in accordance with the invention.

FIG. 2 depicts another embodiment of the invention which allows for regulation of the profile of the coating quantity to be carried out by means of a large-diameter coating bar in accordance with the invention. In FIG. 2, the size-press roll is denoted with reference numeral 6. The roll is provided with a coating 7 in a conventional manner. The coating 7 may be, e.g., rubber or an equivalent. For the purpose in accordance with the invention, the most appropriate hardness of the roll 6 face is about 35 P&J±15 P&J, so that the selection of the material for the coating is carried out on this basis to obtain the correct hardness.

In FIG. 2, the coating bar in accordance with the invention is denoted with reference numeral 31 and, comprises a small-diameter body 32, whose diameter is, e.g., of an order of 12 mm or less. The body 32 of the bar is provided with a suitable outer layer 33, by whose means the diameter of the bar 31 can be made sufficiently large. The outer layer 33 may be formed, e.g., by winding a band or equivalent around the body 32 of the bar.

On the other hand, the outer layer 33 may also consist of bushings **33*a* fitted on the bar body 32, said bushings being attached to one another in a suitable way as non-revolving. Such a embodiment is shown in FIG. 2A, wherein the body 32 of the bar threaded bar, onto which the bushings 33*a* have been fitted. The bushings are provided with appropriate means, by which their rotation in relation to one another is prevented and in the axial direction they are tightened into contact with one another by means of a tightening nut 37 threaded onto the bar. To provide adequate tightness, the bar 32 may be pre-stretched. The mode of fastening shown in FIG. 2**A is particularly well suitable for large diameter bars whose diameter is larger than 25 mm. Differing from which is shown in the Figures, a large-diameter smooth bar can also be made of a tube whose material is, e.g., chromium-plated copper or steel.

In a conventional manner, the bar 31 is installed in order to revolve in cradle 34 which is made, e.g., of polyurethane, and is attached to a cradle holder 35. Between the cradle holder 35 and the cradle 34, loading means, e.g., a loading hose 36 or an equivalent loading member, is fitted so that the bar 31 can be loaded as desired against the roll 6. In the embodiments shown in FIGS. 2 and 2A, when a small-diameter bar body 32 is used, by means of the loading hose 36 the bar 31 can be profiled in a way corresponding to the prior art small-diameter bars.

Figure 3:
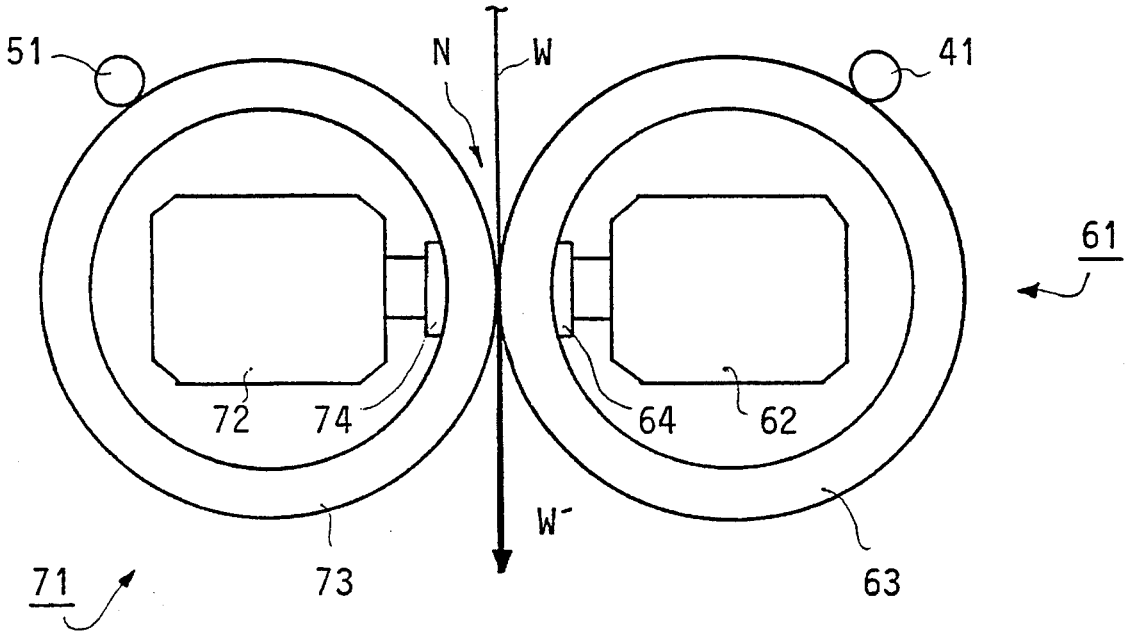
FIG. 3 is a fully schematic side view of an embodiment of the invention by whose means a good final result is obtained in the regulation of the profile of the coating.

FIG. 3 shows another embodiment of the invention which provides a manner for bringing the profile of the coating quantity on the size-press rolls to the correct level by means of coating bars in FIG. 3. Out of the coating devices for the rolls 61 and 71, in FIG. 3, the coating bars 41 and 51 only are shown, while omitting all the other components relates to the coating devices in the illustration of FIG. 3. In the embodiment shown in FIG. 3, the coating bars 41 and 51 are large-diameter bars, having a diameter of at least 18 mm, and preferably about 20 mm.

In the embodiment shown in FIG. 3, the bars 41 and 51 have a unified, solid construction and are consequently quite rigid. Accordingly, the size press rolls 61 and 71 shown in FIG. 3 are variable crown rolls, so that they comprise a rigid central axle 62, 72, on which the roll mantle 63, 73 is arranged in a revolving manner. On the axle 62, 72, hydraulic loading means 64, 74 are provided, which are supported against the inner face of the roll mantle 63, 73 in the plane of the nip N. In addition to the crown variation, the rolls 61 and 71 may be adjustable in zones, even though this is not essential in view of the operability of the invention. Thus, in the embodiment shown in FIG. 3, the profiling is carried out by means of the loading means 64, 74 in the roll nip N itself. For this reason, in the embodiment shown in FIG. 3, the coating bars 41, 51 themselves need not be profiled, because the roll mantle 63, 73 is straight at the coating bar 41, 51. Thus, by means of the embodiment shown in FIG. 3, coating films with uniform profiles are produced on the roll 61, 71 faces.

Instead of the hydraulic means 64, 74 shown in FIG. 3, the crown variation in the size-press rolls 61, 71 may be accomplished so that the rolls 61, 71 are provided with devices fitted inside the roll mantle 63, 73, by means of which devices the temperature of the roll mantle 63, 73 can be adjusted in zones. In such an embodiment, the regulation of the profiles of the size films is carried out by heating or cooling the rolls 61, 71 in zones.

Figure 4:
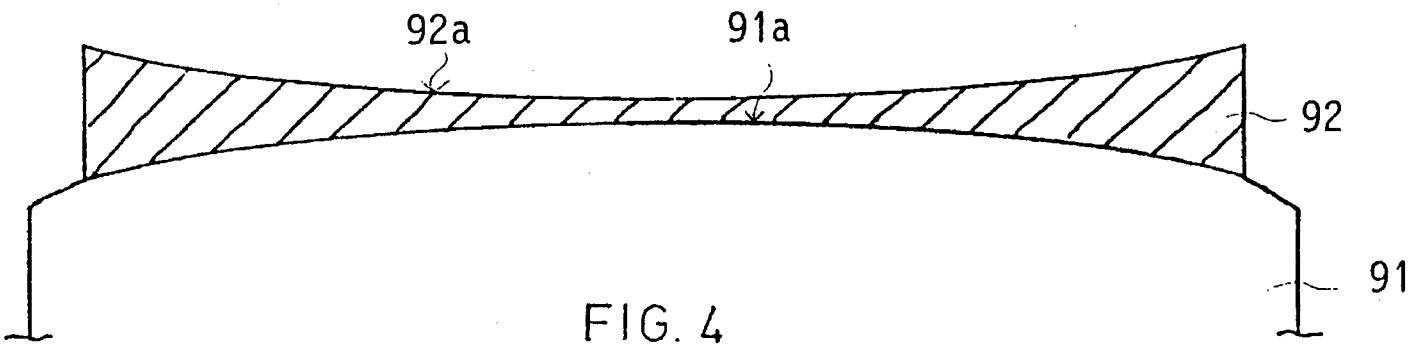
FIGS. 4 and 5 are schematic illustrations of a device in accordance with the present invention for controlling the profile of the coating quantity.
Figure 5:
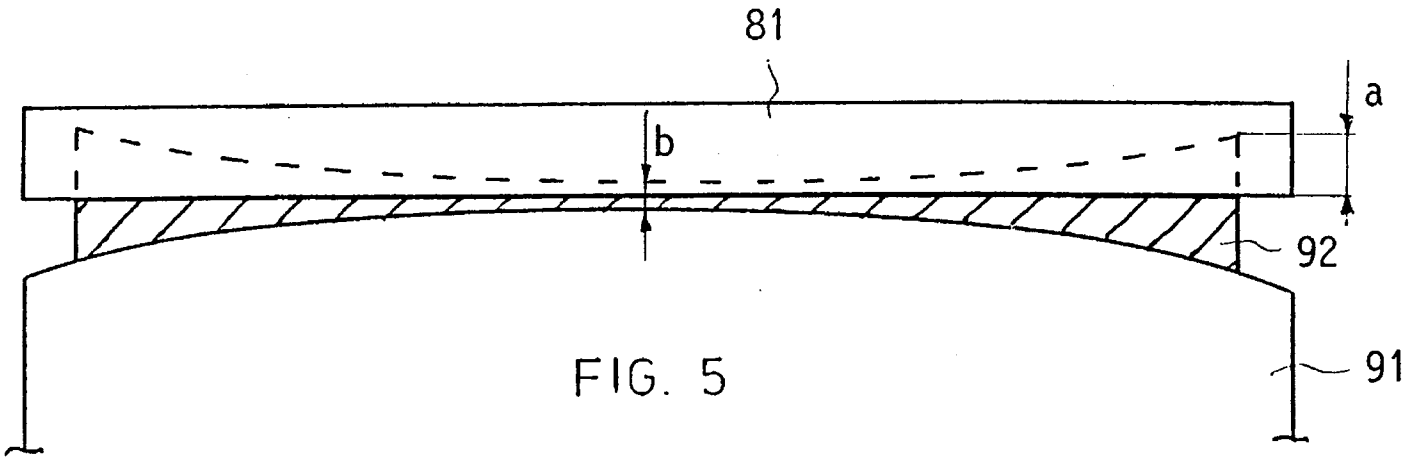

FIGS. 4 and 5 illustrate a further embodiment, by whose means the profile of the coating quantity applied to the roll face can be regulated as desired. FIGS. 4 and 5 are schematic illustrations in the machine direction, showing a part of a roll as well as the coating on the roll face. Further, in FIG. 6, a coating bar is shown schematically. In FIGS. 4 and 5, the roll is denoted with reference numeral 91, the outer face of the roll with reference numeral 91*a*, the roll coating with reference numeral 92, and the outer face of the coating with reference numeral 92*a*. As shown in FIGS. 4 and 5, the outer face 91*a* of the roll is shaped as curved in the axial direction, i.e., crowned. In these Figures, the crowning is shown as remarkably exaggerated, because generally the crowning is of an order of 0.3 mm with a machine width of 7 m. As is shown in FIG. 4, the outer face 92*a* of the roll coating 92 is provided with negative crowning, so that at the ends of the roll the coating 92 is considerably thicker than at the middle of the roll.

FIG. 5 shows an embodiment in which a large-diameter coating bar 81 in accordance with the invention is fitted against the roll. The coating bar 81 is made of solid material, being substantially rigid, in which case, when the coating bar 81 is loaded against the roll, the coating 92 is compressed below the coating bar 81 so that the compression a of the coating 92 in the end areas of the roll is considerably larger than the compression b at the middle of the roll. As the coating 92 is thinner at the middle of the roll than at the roll ends, the compression of the coating is smaller at the middle than at the roll ends. Thus, in a situation as shown in FIG. 5, the linear load between the coating bar 81 and the coating 92 is the same across the entire machine width. In this way, by means of this embodiment, a uniform profile of coating quantity is obtained. Instead of a coating bar 81 made of solid material, in many cases it is possible to achieve sufficiently rigidity by means of an embodiment in which the bar is made of a hollow tube, e.g., of chromium-plated copper or steel.

It is, of course, also contemplated that, e.g., by combining of embodiments shown in FIGS. 3, 4 and 5, a good result is also obtained. In such a combination, the size press would be arranged such that one press roll is a variable-crown roll or a roll adjustable in zones in respect to temperature and the other roll is a owned roll whose coating is provided with negative crowning. As such, the regulating means for regulating the profile of coating quantity being applied to the web W in the nip N would entail at least one of the rolls 61,71 being a variable-crown roll, conventionally provided with a roll mantle against which the loading means 64, 74 engage, wherein a linear contact face located between the coating bar 41,51 and the variable-crown roll 61,71, respectively, is adjusted to be straight via loading means 64,74. Also, the regulating means might consist of one of the rolls 61,71 being a thermally adjustable roll wherein a linear contact face between the coating bar 41,51 and the variable-crown roll 61,71, respectively, is adjusted to be straight by regulating the temperature of the thermally adjustable roll.

Figure 6:
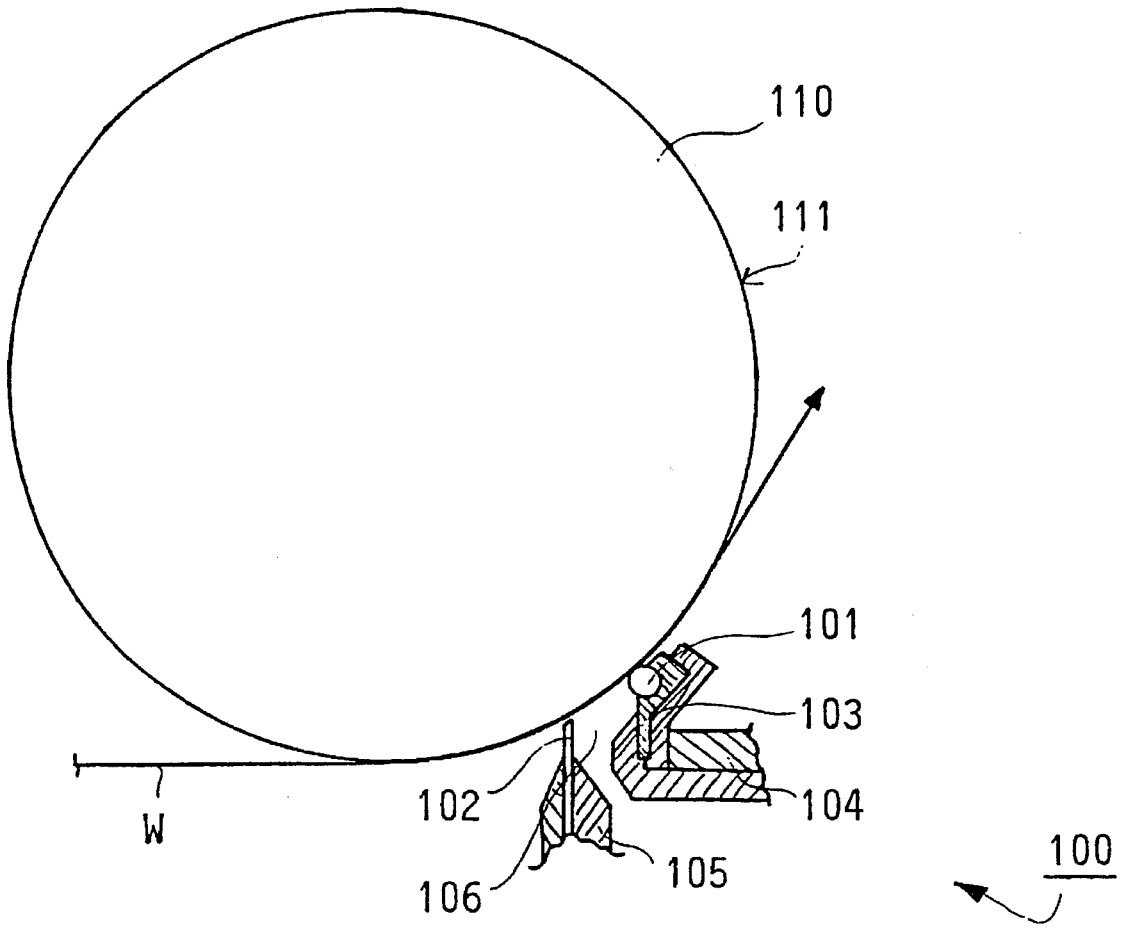
FIG. 6 is a schematic side view of an embodiment of the invention wherein the invention is employed in coating taking place directly on the paper or board web.

The embodiment shown in FIG. 6 illustrates a coating process which takes place directly onto the paper or board web W. In FIG. 6, the roll is denoted with reference numeral 110. The paper or board web W is passed over the roll face 111, and the coating is carried out by means of the coating device 100 directly onto the web W.

The coating device 100 is a coating device of the so-called short-dwell type, which includes a large-diameter coating bar 101 is accordance with the invention mounted as revolving in a cradle 103. The cradle 103 is mounted in a holder 104 in the normal way. The coating bar 101, together with the front wall 102 of the coating device 100, comprises the pressurized coating agent chamber 106, into which the coating agent is introduced. The front wall 102 is mounted on a holder 105 in the normal way.

In test runs that have been carried out, with a coating device in accordance with the invention, excellent results have been obtained. The test runs were carried out with an embodiment wherein a smooth coating bar of a diameter of 20 mm was mounted as revolving in a coating bar cradle of conventional construction. The coating device constructed in this way was fitted in a size press.

By means of the device of this embodiment, test runs were carried out for pigmenting. In some test runs, the dry solids content of the coating paste was 51% and the viscosity 700 cPs. In the test runs, the coating quantity varied in the range of from about 3 to about 10 g per m2 per side, and the running speed varied in the range of from about 800 to about 1200 m per min. The profile of coating quantity that was obtained was very good. Cavitation was so little that almost no cavitation could be noticed. One reason for this was that the diameter of the coating bar was substantially smaller than in roll coaters proper, in which the large roll diameters cause cavitation as the film is split after the nip. The result was substantially better than with any method that was described earlier in the prior art.

Figure 7:
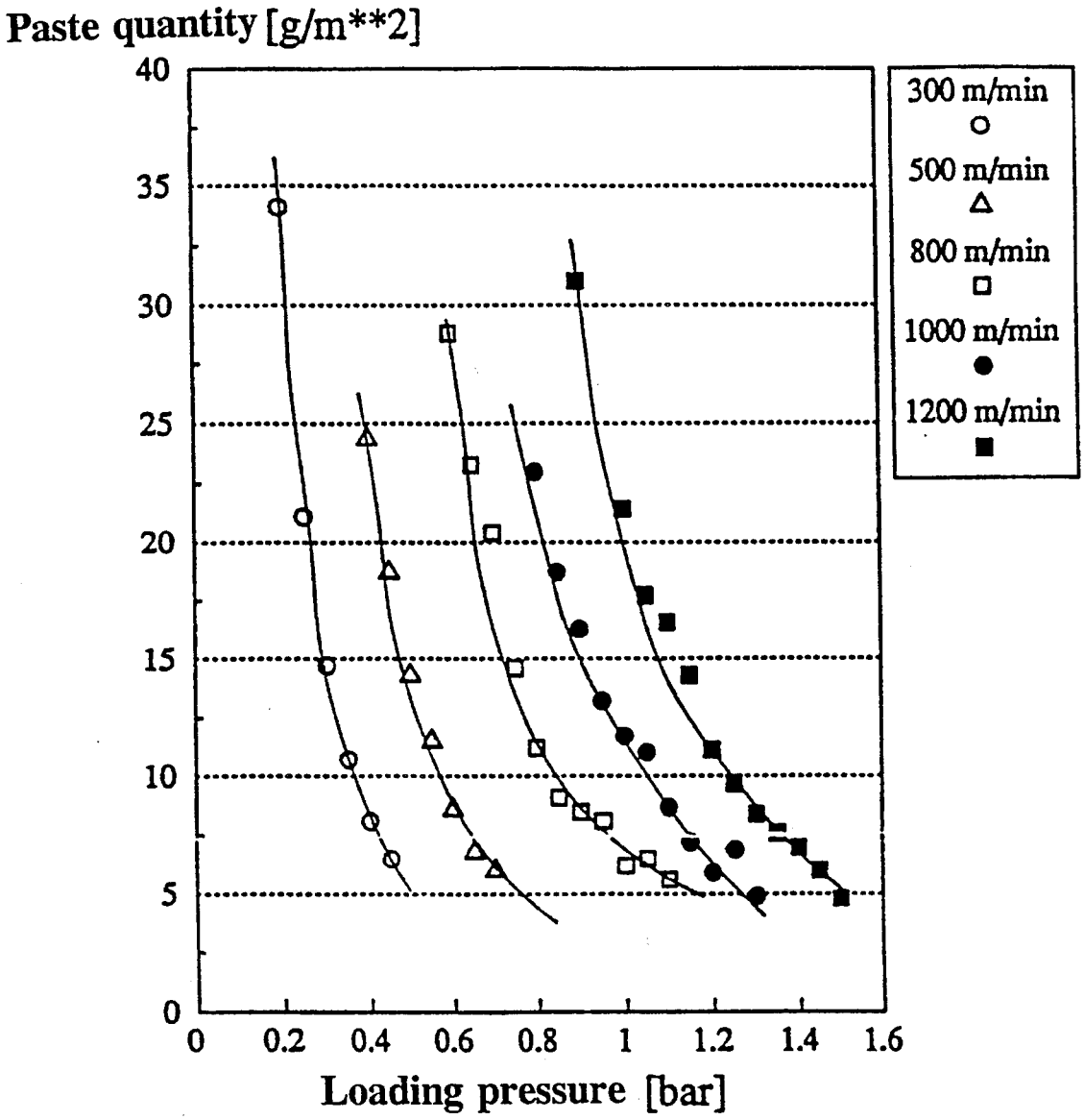
FIG. 7 is a graphic presentation of test results obtained with a coating device in accordance with the invention, the coating quantity being shown as a function of the loading of the coating bar.

Further, FIG. 7 is a graphic presentation of the results obtained with another paste quality. In FIG. 7, the paste quantity obtained is shown as a function of the loading pressure of the coating bar at different running speeds. The tests illustrated in FIG. 7 were also carried out by means of a smooth bar of a diameter of 20 mm mounted in a conventional cradle. The coating paste that was used was PSP kaolin paste, whose dry solids content was 50% and viscosity 550 mPas. The roll in the press was provided with a polyurethane coating. In the test runs, running speeds of 300–1200 m/min were used. The loading pressure indicated in the table expressly means the loading pressure of the coating bar against the roll. As can be clearly seen from FIG. 7, by means of the construction in accordance with the invention, very thin coating quantities were obtained with a high dry solids content of the paste. Thus, by means of the invention, a remarkable improvement is achieved over the prior art. There is a great demand for improvements provided by the method in accordance with the invention in pigmenting and surface sizing of newsprint as well as in surface-sizing of SC-paper.

Figure 8:
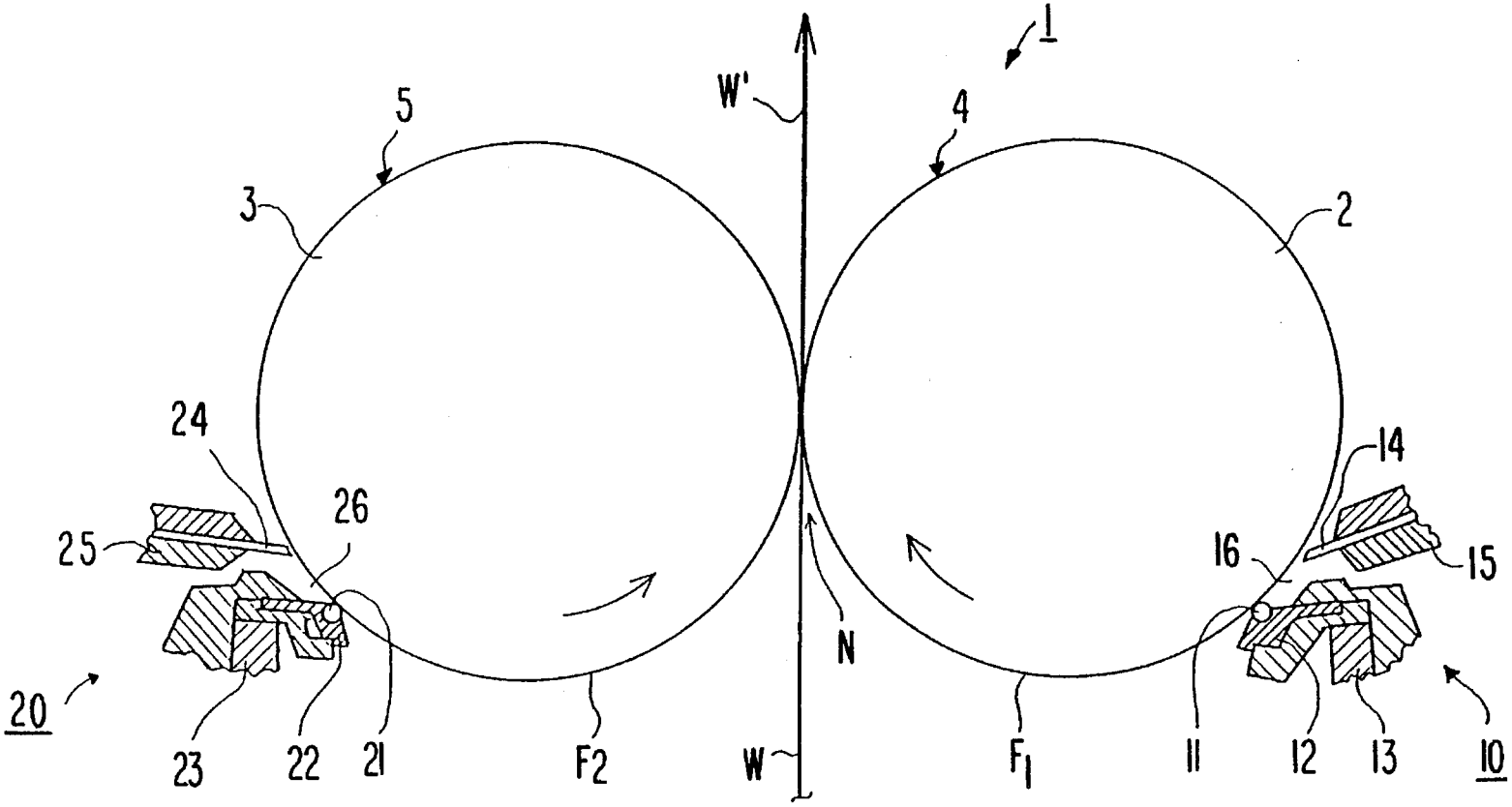
FIG. 8 shows another embodiment of the device in accordance with the invention as used in a size press.

FIG. 8 shows an embodiment of the invention wherein the coating device is of the short-dwell type. The coating devices 10,20 are similar to the coating devices described with respect to FIG. 1. However, in the embodiment illustrated in FIG. 8, the web W' runs in an upward direction through nip N formed between the two size press rolls 2,3. The coating devices 10,20 will therefore operate and coat the press rolls 2,3 on the underside of the rolls 2,3, e.g., on the lower half of the rolls 2,3 when viewed in the running direction of the web W'.

The coating agent is applied from pressurized coating agent chambers 16,26 in each of the devices 10,20, respectively, onto the rolls 2,3. The pressurized chambers 16,26 are closed to prevent overflow of the coating agent and assure that a sufficient pressure prevails in the pressurized chambers 16,26 to apply the coating agent onto the rolls. In this manner, it is not necessary to arrange the coating devices 10,20 to open downward toward the rolls in order to apply the coating agent onto the rolls 2,3, as illustrated in FIG. 1 wherein the coating devices 10,20 are arranged on the topside of the rolls and the coating process utilizes the effect of gravity. Rather, the closed and pressurized chambers 16,26 provide sufficient force to apply the coating agent onto the rolls 2,3 regardless of the positioning of the coating machines 10,20 on the periphery of the rolls 2,3.

A significant advantage of providing a pressurized and closed coating agent chamber 16,26 is that a thicker coating agent can be used to coat the rolls 2,3 than that used in prior art devices. In addition, the web can be arranged to run in an upward direction, as illustrated in FIG. 8. It is not possible to simply change the running direction of the prior art devices, in which the web runs in a downward direction, to obtain such advantages in a device wherein the runs in an upward direction, e.g., the use of a thicker coating agent.

To further assist in the application of the coating agent in the pressurized chambers 16,26, in a preferred embodiment, the bar coaters 12,22 may be inclined downward so that any unrestrained coating agent in the chambers 16,26 flows toward the coating bars 11,21 and thereafter onto the rolls 2,3 as the coating bars 11,21 revolve.

The examples provided above are not meant to be exclusive. Many other variations of the present invention would be obvious to those skilled in the art, and are contemplated to be within the scope of the appended claims.

I claim:

1. A device in a size press for coating a paper web or board comprising a pair of rolls defining a nip through which a paper or board web is passed, a pair of coating machines each having a width and being provided with a moving base comprising one of said pair of rolls, each of said machines comprising means defining a substantially closed and pressurized coating agent chamber through which a coating agent is fed under pressure and applied onto said moving base, said means comprising a revolving coating bar resting against said moving base, said coating bar extending across said machine width and comprising a large diameter smooth-faced coating bar having a diameter from about 25 mm to about 80 mm, said coating chamber being arranged before said coating bar in a running direction of said moving base such that said coating bar spreads and smoothes the coating agent applied onto said moving base, and a cradle supporting said coating bar substantially over its entire length, and said device further comprising regulating means for regulating the profile of coating quantity on the web, said regulating means comprising at least a first one of said pair of rolls being a variable-crown roll wherein a linear contact face defined between said coating bar and said variable-crown roll is adjusted to be straight via loading means.

2. The device of claim 1, wherein said first one of said pair of rolls is provided with a coating arranged to provide said rolls with a negative crowning.

3. The device of claim 1, wherein said pair of machines are arranged to coat a lower portion of said pair of rolls.

4. The device of claim 1, wherein said pair of machines are arranged such that said coating bar in each of said pair of machines is at a lowermost position in said chamber.

5. The device of claim 1, wherein said coating bar comprises a uniform solid material.

6. The device of claim 1, wherein said regulating means further comprise a second one of said pair of rolls being a variable-crown roll wherein a linear contact face of said variable-crown roll located between said coating bar and said variable-crown roll is adjusted to be straight via loading means, or said second one or said pair of rolls being a thermally adjustable roll wherein a linear contact face defined between said coating bar and said thermally adjustable roll is adjusted to be straight by regulating the temperature of said thermally adjustable roll.

7. A coating device in a size press which coats a moving base, comprising a coating machine having a width, said machine being provided with a moving base comprising a first roll, said first roll defining a nip with a second roll through which a paper or board web is passed in an upward direction, means defining a substantially closed and pressurized coating chamber through which a coating agent is fed under pressure and applied onto said first roll, said means comprising a revolving coating bar supported against said first roll and extending across said machine width, said coating bar comprising a large diameter smooth-faced bar having a diameter from about 25 mm to about 80 mm, and regulating means structured and arranged to control the profile of said coating agent applied to said moving base, said regulating means comprising at least said first roll being a variable-crown roll or a thermally adjustable roll, wherein a linear contact face of said variable-crown roll defined between said coating bar and said variable-crown roll is adjusted to be straight via loading means, or a linear contact face defined between said coating bar and said thermally adjustable roll is adjusted to be straight by regulating the temperature of said thermally adjustable roll, said large-diameter coating bar comprising a bar body having a small diameter, and an outer layer arranged on said bar body, said outer layer permitting profiling of the coating bar in a transverse direction of the machine.

8. The device of claim 7, wherein said outer layer comprises a band material wound onto said bar body.

9. The device of claim 7, wherein said outer layer of said coating bar comprises smooth-faced bushings fitted onto said bar body and attached to one another as non-revolving.

10. The device of claim 9, wherein said bushings are attached to one another by being tightened in an axial direction via tightening means attached to said coating bar.

11. The device of claim 7, wherein said coating bar comprises a uniform solid material.

12. The device of claim 7, wherein said smooth-faced coating bar comprises a tubular coating bar.

13. The device of claim 12, wherein the material of the tubular coating bar is chromium-plated copper or steel.

14. The device of claim 7, wherein said first and said second rolls are variable-crown rolls or rolls thermally adjustable in zones.

15. The device of claim 7, wherein said second roll is a rigid crowned roll having a coating shaped so that the outer face of said second roll is negatively crowned.

16. The device of claim 7, wherein said first roll is provided with a coating arranged to provide said first roll with a negative crowning.

17. The device of claim 7, wherein said regulating means further comprise said second roll being a variable-crown roll or a thermally adjustable roll, wherein a linear contact face of said variable-crown roll defined between said coating bar and said variable-crown roll is adjusted to be straight via loading means, or a linear contact face defined between said coating bar and said thermally adjustable roll is adjusted to be straight by regulating the temperature of said thermally adjustable roll.

18. The device of claim 1, wherein the paper web or board is passed in a substantially vertical upward direction through said nip.

19. A device in a size press for coating a paper web or board comprising a pair of rolls defining a nip through which a paper or board web is passed, a pair of coating machines each having a width and being provided with a moving base comprising one of said pair of rolls, each of said machines comprising means defining a substantially closed and pressurized coating agent chamber through which a coating agent is fed under pressure and applied onto said moving base, said means comprising a revolving coating bar resting against said moving base, said coating bar extending across said machine width and comprising a large diameter smooth-faced coating bar having a diameter from about 25 mm to about 80 mm, said coating chamber being arranged before said coating bar in a running direction of said moving base such that said coating bar spreads and smoothes the coating agent applied onto said moving base, and a cradle supporting said coating bar substantially over its entire length, and said device further comprising regulating means for regulating the profile of coating quantity on the web, said regulating means comprising at least a first one of said pair of rolls being a thermally adjustable roll wherein a linear contact face defined between said coating bar and said thermally adjustable roll is adjusted to be straight by regulating the temperature of said thermally adjustable roll.

20. The device of claim 19, wherein said regulating means further comprise a second one of said pair of rolls being a variable-crown roll wherein a linear contact face of said variable-crown roll located between said coating bar and said variable-crown roll is adjusted to be straight via loading means, or said second one of said pair of rolls being a thermally adjustable roll wherein a linear contact face, defined between said coating bar and said thermally adjustable roll is adjusted to be straight by regulating the temperature of said thermally adjustable roll.

* * * * *